United States Patent [19]

Clark

[11] Patent Number: 4,514,024

[45] Date of Patent: Apr. 30, 1985

[54] SHIELDED ELECTRICAL CONNECTOR

[75] Inventor: Thomas A. Clark, Santa Monica, Calif.

[73] Assignee: Automation Industries, Inc., Greenwich, Conn.

[21] Appl. No.: 414,918

[22] Filed: Sep. 3, 1982

[51] Int. Cl.[3] ..... H01R 13/453

[52] U.S. Cl. ..... 339/40; 339/41; 339/143 R

[58] Field of Search ..... 339/143 R, 40, 41

[56] References Cited

U.S. PATENT DOCUMENTS

| | | | |
|---|---|---|---|
| 2,095,254 | 10/1937 | Holliday et al. | 339/143 R |
| 3,535,676 | 10/1970 | Schultz | 339/143 R |
| 3,853,376 | 12/1974 | Marechal | 339/41 |
| 4,203,640 | 5/1980 | Bice et al. | 339/41 |
| 4,217,019 | 8/1980 | Cameron | 339/40 |

FOREIGN PATENT DOCUMENTS

| | | | |
|---|---|---|---|
| 2210513 | 9/1973 | Fed. Rep. of Germany | 339/41 |
| 2328833 | 6/1974 | Fed. Rep. of Germany | 339/41 |

*Primary Examiner*—John McQuade
*Assistant Examiner*—Thomas M. Kline
*Attorney, Agent, or Firm*—Francis N. Carten

[57] ABSTRACT

One connector part has an end face with openings aligned with the contacts. A transferable metal plate has openings which can be aligned with the contacts and the end face openings, the plate and end face openings being sufficient to receive a pin contact without shorting out. The plate is located in front of the socket contacts and spring-loaded to urge an edge outwardly of the connector part or shell. With the connector parts disconnected, the metal plate partially blocks off the end face openings. On mating of the connector parts, the shell of the other connector part engages the protruding plate edge camming the plate to align the plate openings with the openings of the socket contacts. Alternatively, the shield plate is mounted on the connector part to rotate from a first position where the plate openings are aligned with end face openings and contacts, to a second position of rotation where the shield plate openings are out of alignment and partially covering the contacts to shield them from external fields. An actuator arm cammed by the shell housing of the other connector part during mating aligns the shield plate openings and contacts.

4 Claims, 9 Drawing Figures

SHIELDED ELECTRICAL CONNECTOR

The present invention relates generally to an electrical connector, and, more particularly, to a pin and socket electrical connector having releasably mateable plug and receptacle parts with the connector part carrying the socket contact being shielded against the adverse effects of an electromagnetic energy environment.

BACKGROUND OF THE INVENTION

A well-known electrical connector includes plug and receptacle parts that are joinable to produce electrical connection between pins and sockets carried by the respective parts. The connector parts include heavy metal shell housings which, when the connector parts are mated, provide good protection against external electromagnetic fields that would otherwise induce undesirable electric signals in the cable wires and thus into the equipment to which the cable wires are connected. When the plug and receptacle parts are disengaged, exposed contacts which are directly connected to the cable wires can, at that time, be adversely affected by environmental electromagnetic fields.

U.S. Pat. No. 3,550,065 discloses the use of a metal plate that is received over the open end of a connector part including one or more socket contacts, the plate having openings via which pins from the other connector part can pass during mating of the connector. The grid plate or shield is electrically connected to the connector part casing or outer shell and in this way serves as a means for reflecting and absorbing a significant portion of ambient environmental electromagnetic energy.

The shield described in the referenced U.S. patent is effective for many uses; however, present-day electromagnetic environments are becoming increasingly more severe, both as to intensity and frequency, and the shield openings which are of sufficient size to admit a pin contact also provide a means for access of such energy to the socket contacts. Exemplary of the type of extreme environments within which a connector of this kind may be subjected, in the event of a nuclear explosion, an electromagnetic pulse (EMP) is produced which can, by itself, induce damaging electrical and electronic equipment located at distances from the blast that would be sufficient to protect it from the direct blast effects.

SUMMARY OF THE INVENTION

In the connector part which includes the socket contacts, which may be either the plug or receptacle a metal end face has openings aligned with the socket contacts. A transferable foraminous metal plate has the openings arranged so that they can be brought into alignment with corresponding socket contacts and the end face openings in the connector part, the plate and end face openings being sufficient in cross-sectional dimension to enable a pin contact to pass therethrough without shorting out. The plate is located within a slot in the connector part housing in front of the socket contacts and spring-loaded to urge an edge outwardly of the connector part housing or shell.

With the connector parts disconnected, the metal plate is so disposed as to present solid plate material immediately opposite the end face openings partially blocking them off. On engagement during mating of the connector parts to one another, the shell housing of the connector part having pin contacts engages the protruding plate edge camming the plate transversely of the connector part within the slot in which it is received aligning the plate openings with the openings of the socket contacts. In this way pin contacts can interconnect with the socket contacts. Again, on disengagement of the connector parts the spring-loaded plate automatically shifts to a position providing partial covering of the end face opening thereby protecting the socket contacts from externally existing electromagnetic energy.

In an alternate embodiment, the shield plate is rotatably mounted on the connector part from a first position where the plate openings are aligned with end face openings and the socket contacts. At a second position of rotation, the shield plate openings are all out of alignment with the end face openings so that the plate metal partially covers the contacts shielding them from external fields.

An actuator arm extends from an edge of the shield plate and is cammed by the shell housing of the other connector part during mating to align the shield plate openings and socket contact.

DESCRIPTION OF PREFERRED EMBODIMENTS

Figure 1:
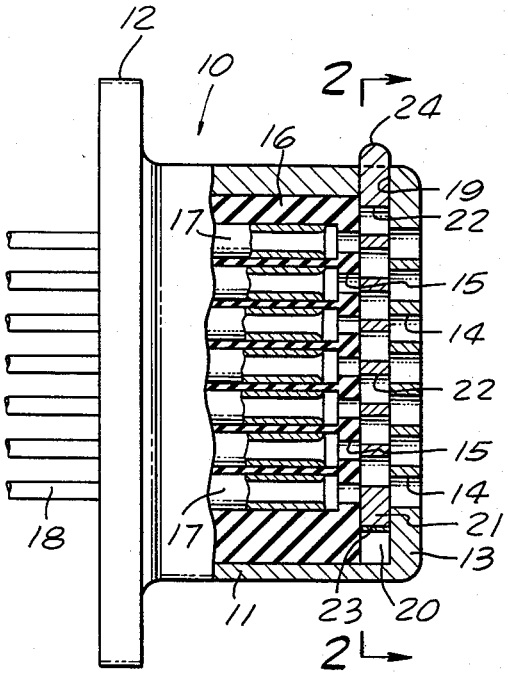
FIG. 1 is a side elevational, sectional, partially fragmentary view of a connector part incorporating the electromagnetic shield of this invention.

With reference now to the drawing, and particularly to FIG. 1, there is shown a receptacle 10 which is one of the connector parts of a plug and receptacle electrical connector. In its major constituents, the receptacle typically includes a hollow cylindrical metal shell 11 having one end affixed (e.g., welded) to a mounting plate or flange 12 and its other end closed by an end face 13. The face 13 includes a plurality of openings 14 which align with openings 15 in a plastic or rubber insert 16 located within the bore of the connector shell 11. The insert openings 15 communicate with individual cavities within which are located socket contacts 17, the latter being interconnected with cable wires 18 in conventional manner.

The openings 14 in the face of the receptacle have a cross-sectional dimension which is substantially greater than that of a pin contact to be described, such that as the pin is inserted through the openings 14 it can be readily accommodated without danger of shorting out to the adjacent wall surfaces of the receptacle face.

Figure 2:
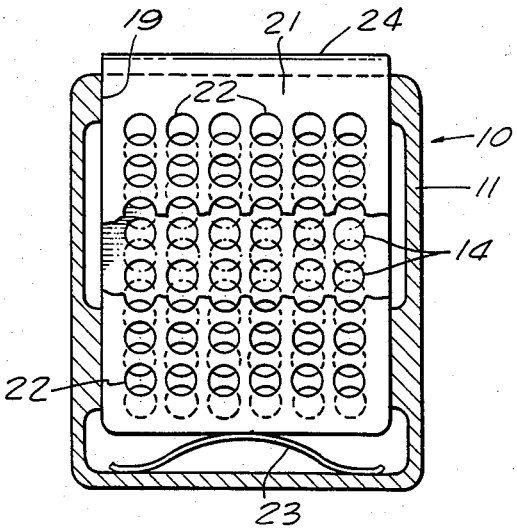
FIG. 2 is an end elevational, sectional view taken along the line 2—2 of FIG. 1.
Figure 4:
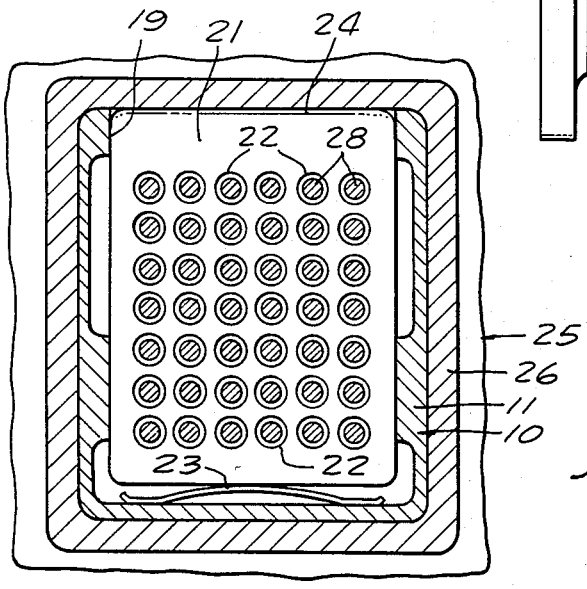
FIG. 4 is an end elevational, sectional view taken along the line 4—4 of FIG. 3.
Figure 5:
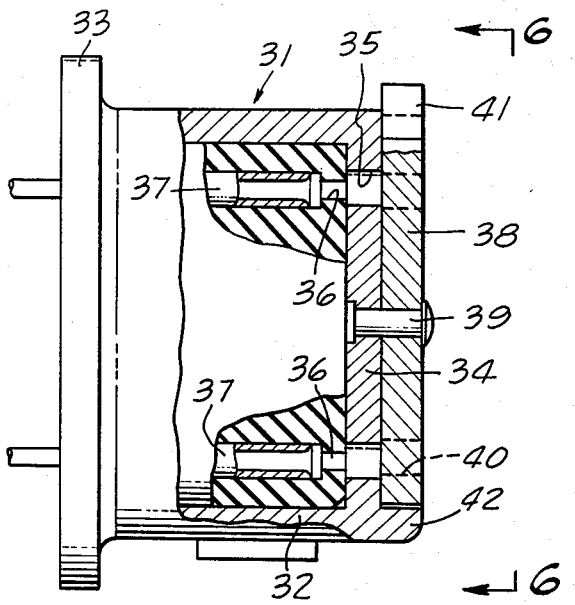
FIG. 5 is a side elevational sectional partially fragmentary view of a connector part employing an alternate embodiment of electromagnetic shield.

An elongated slot 19 is formed in the side wall of the receptacle shell immediately adjacent the end face 13 and has an extent slightly greater than the entire width of the openings 15 (FIGS. 2 and 4). The slot opens into a space 20 that lies between the inner surface of end face 13 and the outer surface of insert 16.

A metal plate or shield 21 of substantially rectangular geometry is slidingly received within the space 20 and has a plurality of openings 22 of the same size and arrangement as the receptacle end face openings 14. That is, as will be described, the shield 21 can be so located that each of the openings 14 will be aligned with an opening 22.

As shown in FIGS. 2 and 4, the inner edge of the shield or plate 21 is resiliently spaced from the side wall of receptacle shell 11 by an elongated leaf spring 23. More particularly, the leaf spring 23 continuously and resiliently urges the innermost edge or side of the shield 21 away from the receptacle wall such that the opposite edge of the shield extends outwardly of the slot 19 as at 24. In this manner, when the connector parts are disengaged, the shield plate 21 is as is shown in FIGS. 1 and 2 with shield metal portions between adjacent openings 22 lying directly opposite openings 15 in the insert 16. It is important to note that the shield metal between openings 22 covers part but not all of an immediately adjacent opening 14.

The outer edge 24 of the shield which extends beyond the receptacle shell during disengagement of connector parts is rounded or beveled for accommodating the plug shell in a manner to be described for actuating the shield 21 to the open condition.

FIG. 4 shows the connector receptacle of FIG. 1 mated with a plug 25 of conventional construction. Such a plug typically includes a hollow metal shell or housing 26 of such dimensions as to receive the receptacle shell 11 therewithin. An insulative insert 27 includes a plurality of pin contacts or pins 28 of such geometry and dimensions as to permit fitting receipt within the socket contacts 17 of the receptacle when the connector parts are mated to interconnect cable wires 18 of the receptacle to cable wires 29 of the plug.

Figure 3:
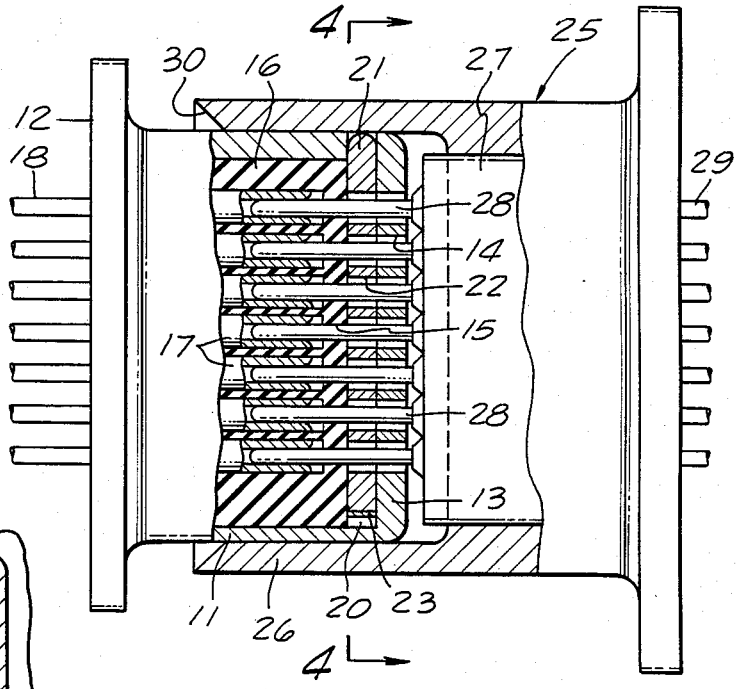
FIG. 3 is a side elevational, sectional, partially fragmentary view of a receptacle and plug shown in mated condition.

During the initial state of mating the plug 25 to the receptacle 10, the leading edge of the plug shell 26 engages the outwardly extending shield edge 24 moving it from the position shown in FIG. 1 to the inner position shown in FIG. 3. To aid in this the outer end of the plug shell is beveled as at 30 to prevent hanging up on engagement with edge 24. When the plate is moved to the position shown in FIG. 3, the pins 28 can then pass completely through the openings 14, openings 22 in the shield, the insert openings 15, and finally into full connecting relationship with the socket contacts. Removal of the plug from engagement with the receptacle causes the shield 21 to return to its electromagnetic energy blocking mode as in FIG. 1 as a result of the operation of leaf spring 23.

Reference now is made to FIGS. 5 through 9 and an alternate embodiment of the present invention. As can be seen best in FIG. 5, the receptacle 31 is substantially identical in construction to the receptacle 10 in the first described embodiment in that it has a cylindrical shell 32 one end of which is secured to a mounting plate 33, and the other end is closed off by a face 34. The end face has a plurality of openings 35 which are aligned with further openings in an insert 36 via which access is had to socket contacts 37 mounted therewithin. Over the outwardly directed surface of the face 34 there is arranged a shield plate 38 rotatably mounted thereto by a pin 39.

Figure 6:
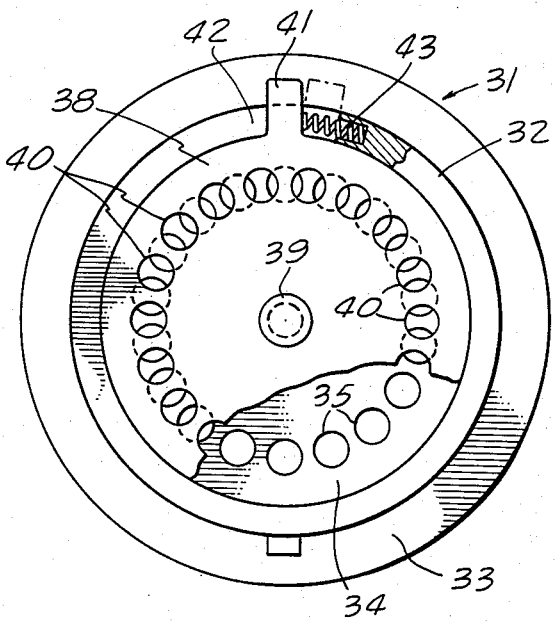
FIG. 6 is an end elevational view taken along the line 6—6 of FIG. 5.

The shield plate 38 has a plurality of openings 40 of such arrangement as to enable them to be brought into precise alignment with openings 35 upon rotation of the plate to a predetermined orientation. As shown in FIG. 6, the shield plate is substantially circular and includes an actuator arm 41 extending radially outwardly of the plate circumference. The shield plate is enclosed at its sides by a circumferentially extending ridge or wall 42 that is upstanding from the receptacle face 34. A gap is provided at one portion of the wall 42 for receiving the actuator arm 41 therethrough. A coil spring 43 has one end received within an opening in the wall 42 and its other end in resilient force exerting relationship against the side of the actuator arm 41 serving to urge it continuously against the edge wall surface of the wall 42 defining the wall gap as shown in FIG. 6.

When in the position shown in FIG. 6, the connector parts are disconnected and the openings in the shield plate 38 are so located relatively to the openings 35 in the receptacle face as to partially cover them with plate material. Accordingly, in this arrangement the plate 38 serves as a shield against impinging electromagnetic energy passing through the openings 35 to induce undesirable currents in the socket contacts.

Figure 7:
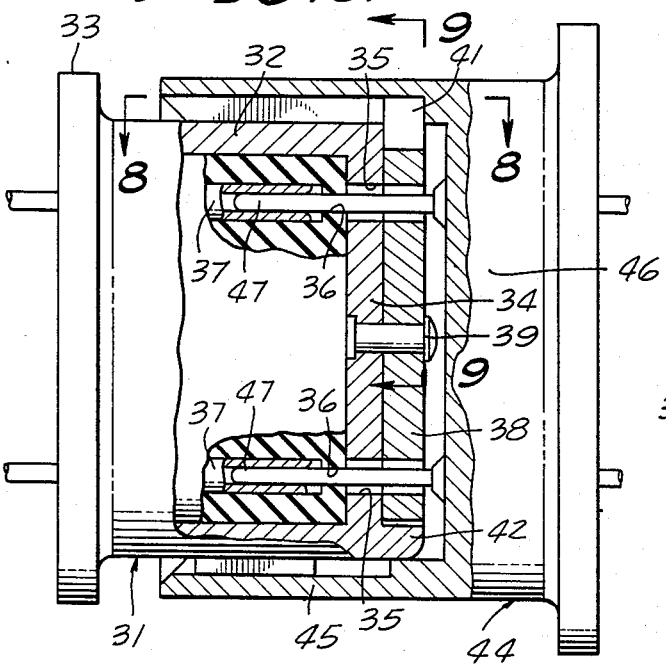
FIG. 7 is a side elevational, sectional, partially fragmentary view of a mated plug and receptacle connector showing the alternate form of electromagnetic shield.
Figure 8:
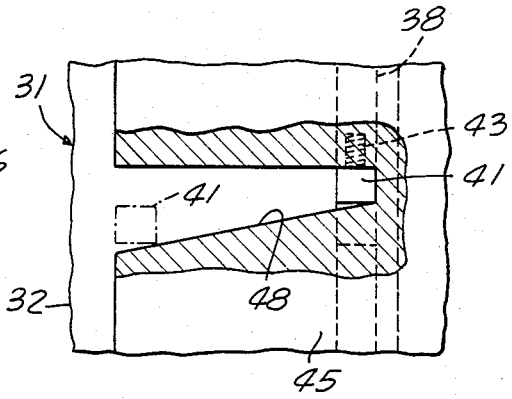
FIG. 8 is a top plan sectional view taken along the line 8—8 of FIG. 7.
Figure 9:
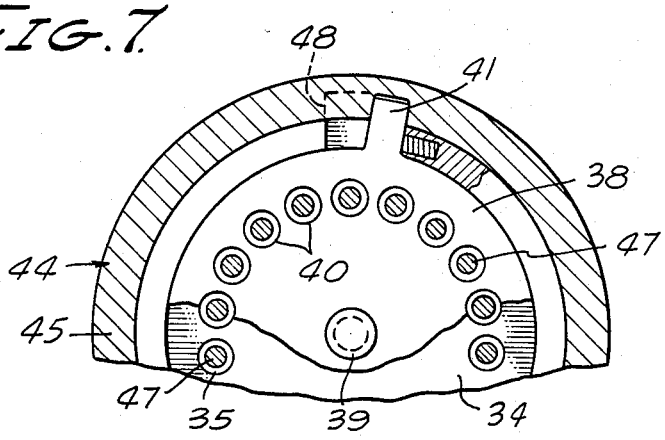
FIG. 9 is an end elevational, sectional, partially fragmentary view taken along the line 9—9 of FIG. 7.

The plug 44 is of overall construction substantially identical to the plug 25 described in connection with the first embodiment of this invention. In particular, the plug includes an open ended shell 45 with an included insulative insert 46 having a plurality of pin contacts 47 which extend forwardly of the plug in conventional manner. Turning to FIG. 8, the interior surface of the plug shell 45 is furnished with a camming wall 48 extending longitudinally of the plug shell and angularly disposed with respect to the shell longitudinal axis. The camming wall on mating of the plug and receptacle engages the shield plate actuator arm 41 moving it from the position shown in FIG. 6 to that shown in FIG. 9, the latter being where the openings 40 in the shield plate align with the openings 35 in the receptacle face thereby permitting access of the pin contacts for mating receipt within the socket contacts. The fully mated condition is shown in FIG. 7.

In either of the described embodiments, the openings in the receptacle end face are partially closed or intercepted by metal parts of the shield when the connector parts are separated. It has been found that reducing the cross-sectional dimensions of the access openings in this way extends the range of grid effectiveness specifically because the smaller sized openings provide what is termed a "waveguide below cut-off" effect at a higher frequency. This is an important aspect in making the described shielding means applicable to high-density connectors (i.e., connectors having a large number of contacts), which, because of necessarily close spacing between adjacent shield openings, would not have sufficient metal to completely cover or block the end face openings.

I claim:

1. An electrical connector having a metal receptacle shell within which at least one socket contact is carried within an insulative insert, and an open-ended metal plug shell adapted for fitting receipt onto the receptacle shell and including an insulative insert with a pin contact for interconnecting with socket contact on mating of the plug and receptacle shells, comprising:

a face wall integral with the receptacle shell and having an opening lying opposite the socket contact and through which the pin contact passes during mating of the plug and receptacle;

a platelike member slidably located within a cavity between the face wall and the insulative insert within the receptacle shell, and having an opening therein, said platelike member further having an edge that extends outwardly of the receptacle shell when the plug and receptacle shells are disengaged and which, on mating engagement of the plug and receptacle shells, means on the plug shell moves the outwardly extending plate-like member edge into the receptacle shell to a first position aligning the platelike member opening with the face wall opening; and spring means urging the platelike member toward a second position where the face wall opening and the platelike member opening are out of alignment.

2. An electrical connector as in claim 1, in which the spring means includes a leaf spring that resiliently engages both a further edge of the platelike member and an inner surface of the receptacle shell.

3. An electrical connector as in claim 1, in which the opening in the receptacle shell face wall and the opening in the platelike member are substantially greater in transverse dimensions than the pin contact cross-section so as to admit the pin contact therethrough without contacting either the receptacle shell face wall or the platelike member.

4. An electrical connector as in claim 1, in which the platelike member slidingly contacts both the receptacle shell face wall and the insulative insert.

* * * * *